United States Patent [19]

Henrikson

[11] Patent Number: 4,817,861

[45] Date of Patent: Apr. 4, 1989

[54] FILE STORAGE CARTON

[76] Inventor: Gregory A. Henrikson, 550 South Laredo Cir., Aurora, Colo. 80017

[21] Appl. No.: 137,689

[22] Filed: Feb. 24, 1987

[51] Int. Cl.[4] ..... B65D 5/02

[52] U.S. Cl. ..... 229/122; 206/425; 229/152; 229/52 B

[58] Field of Search ..... 229/122, 125, 37, 125, 229/39, 145, 152, 6 R, 16 R, 52 B; 206/425, 45.17

[56] References Cited

U.S. PATENT DOCUMENTS

| | | | |
|---|---|---|---|
| 585,463 | 6/1897 | Doble | 229/122 |
| 1,334,687 | 3/1920 | Wilson | 229/145 |
| 1,544,499 | 6/1925 | Sunderman | 229/122 |
| 1,980,482 | 11/1934 | Golden | 229/122 |
| 2,104,828 | 1/1938 | Brinnon | 229/122 |
| 2,281,061 | 4/1942 | Boeye | 229/52 B |
| 2,663,485 | 12/1953 | Johnson | 229/122 |
| 2,698,124 | 12/1954 | Hines | 229/122 |
| 2,855,096 | 10/1958 | Aull | 206/45.17 |
| 3,143,274 | 8/1964 | Maize | 229/122 |
| 3,307,770 | 3/1967 | Wysocki | 229/122 |
| 3,550,837 | 12/1970 | Erb | 229/145 |
| 3,858,720 | 1/1975 | Flagler | 229/122 |
| 4,066,205 | 1/1978 | Griffith | 229/122 |
| 4,138,051 | 2/1979 | Zicko | 229/122 |
| 4,373,660 | 2/1983 | Wytko | 229/145 |
| 4,437,713 | 3/1984 | Roach | 229/122 |

FOREIGN PATENT DOCUMENTS

| | | | |
|---|---|---|---|
| 2407862 | 6/1979 | France | 229/122 |

*Primary Examiner*—Stephen Marcus
*Assistant Examiner*—Gary E. Elkins
*Attorney, Agent, or Firm*—Edwin L. Spangler, Jr.

[57] ABSTRACT

This invention relates to a stackable file storage carton characterized by an open-front box fitted with an integrally formed access opening cover hingedly attached to the bottom of the box along the front edge of the latter for movement from a closed position into an open one forming an extension of said box bottom. The access opening cover is comprised of a panel sized and shaped to cover the access opening. This panel is bordered along its free edges by upstanding fence-forming flanges cooperating therewith and with one another to define a tray which in open position is adapted to receive and support a file slid forwardly from within the box. The front flange is formed to provide a pocket extending lengthwise thereof which is open at both ends to receive and hold tabs depending from the front edges of the flanges bordering the sides of the cover panel. When thus interconnected and with one or more tongues depending from a section of the front flange seated in slits in the cover panel alongside thereof, the interlocked connection between the flanges is complete and effective to maintain them in upstanding position relative to one another and to the cover panel.

3 Claims, 2 Drawing Sheets

FILE STORAGE CARTON

BACKGROUND OF THE INVENTION

The tremendous amount of paper being generated today by all different types of businesses is creating an ever increasing storage problem. The cost of office space is such that an efficiency run business cannot afford the luxury of setting aside useful "people-space" for the storage of dead files. Also, the traditional lockable metal file cabinet of good reasonably fire-resistant quality runs close to a thousand dollars in the larger sizes, if not more. Even the cheaper ones cost too much to use for dead storage.

Accordingly, relatively inexpensive cardboard file storage cartons have become increasingly popular for use in the storage of files that need to be saved but are seldom accessed. Moreover, when large numbers of these files exist, the tendency is to store them off-site where the rent per square foot is less than in the primary office facility. A valuable adjunct are those off-site storage facilities run by third parties who will pick up, store and retrieve files for a modest monthly fee or some other comparable arrangement. To operate such a facility efficiently, however, takes more than just throwing the files into a box and piling the boxes on top of one another.

To begin with, one essential is to have a box or carton which is specially designed to accommodate the particular type of file to be stored of which there are many. Secondly, the file storage cartons must be stackable several high without crushing the contents. Most significant of all, however, is the ability to access a file in a particular carton without having to unpile or otherwise disturb the stack. Finally, and equally important, has to be the ability to read the identifying indicia on the individual files without having to remove them from the carton.

FIELD OF THE INVENTION

Accordingly, the present invention relates to file storage cartons and, more specifically, to those cartons which are stackable and yet openable when stacked to reveal the file-identifying indicia for each individual file which is displayed either upon integral tabs projecting from the front edge thereof or, alternatively, the ones color-coded along the front edge which are oftentimes tabless.

DESCRIPTION OF THE RELATED ART

Of the cartons specifically designed for use in the storage of files, applicant is aware of four patented ones, namely: Geibel, U.S. Pat. No. 3,645,437; Cavan, U.S. Pat. No. 4,269,347; Locatelli, U.S. Pat. No. 4,295,599; and, Poteet, U.S. Pat. No. 4,339,069. Of these, all but the Cavancarton are top-opening ones unsuited for use with files of the type used in so-called "open storage" or in "drop-front" filing cabinets where the file-identifying indicia is provided along the front edge rather than along the top. Also, when stacked on atop another, access to the files in the carton underneath become inaccessible without unpiling the stack.

Cavan, on the other hand, recognized the problem of accessing the individual files regardless of the placement of the identifying indicia once such files are placed in top-opening cartons and stacked one atop another. His carton was specifically designed, as is the present one, for end-tab type files and color-coded tabless ones which are stored extending front-to-rear as opposed to sideways in open-storage doorless racks or drop front file cabinets. His unit is provided with windowed front-opening flaps through which a part, but not all, of the indicia-bearing edge of the file is visible. It differs from that of the present invention in that apparently the files lay flat in the bottom of the carton instead of upright and on edge corresponding to the manner in which such files are actually used. Applicant's unit, on the other hand, has an integrally-formed and marginally-flanged drop-front tray-like front access opening cover attached along its lower edge which opens to reveal the entire indicia-bearing edge of each file stored therein. In addition, an integrally-formed front flap attached along its upper edge folds down over the exposed face of the access opening cover above the hand-hold in the latter where it is detachably connected thereto by means of a releasable connection such as a pile-and-loop fastener which holds the cover closed in place of Cavan's tongue and slot connection. A second hand-hold in the rear wall of the carton cooperates with the one in the front to facilitate lifting the carton even when loaded with files thus maintaining them in their normal upright position. Cavan's file storage box is devoid of hand-holds.

There are, of course, many cartons used for purposes other than the storage of files, some of which are front opening and even provided with adhesive connections to hold a front flap closed. An example of such a carton is that of Daller, U.S. Pat. No. 1,888,818. An open-topped box having hand-holds front and rear is disclosed in Giebel et al, U.S. Pat. No. 3,727,824; however, it is ill-suited for file storage for the same reasons set forth above with respect to some of the top-opening file storage boxes. Other top-opening cartons are found in Locke, U.S. Pat. No. 3,843,040; Kitchell, U.S. Pat. No. 3,471,077; O'Brien, U.S. Pat. No. 2,174,179; Adams, U.S. Pat. No. 2,927,720; Heiser, U.S. Pat. No. 1,339,334; and, Clark, U.S. Pat. No. 3,734,392, none of which is suitable for readily accessible file storage especially when stored one atop another.

SUMMARY OF THE INVENTION

The present invention, therefore, relates to a specially designed and constructed file storage carton having a drop-front integrally-formed tray-like access opening cover which when open reveals the entire indicia-bearing front edge of each and every file contained therein. Since the length of the files is greater than the height of the access opening cover, when the latter is open and laid flat its marginally-flanged side edges and top cooperate with the front wall of the carton to define a shallow tray upon which a major portion of each file can rest when pulled forward into position to be examined. A folded double-thickness flange extends along the top edge of the access opening cover and provides tab-receiving slots at its ends which receives tabs on the front ends of the side margin flanges that lock the three together in tray-forming relation. The exposed face of the access opening cover and the hidden face of the flap at the top of the carton are provided with releasable fasteners, preferably of the pile-and-loop type, which, when secured, hold the cover closed. The sides and rear wall are all of double-thickness construction and, as such, they provide more than enough strength to bear the loads imposed upon the top and bottom of the carton when several are stacked one atop another. A handhold in the access opening cover facilitates removal of the carton from a stack thereof, whereas, one in the rear wall cooperates with the one in the front for lifting purposes.

It is, therefore, the principal object of the present invention to provide a file storage container especially adapted for use in the storage of upright files carrying the file-identifying indicia on the front exposed edge thereof.

A second objective is the provision of a file storage container of the type aforementioned in which access to the contents is gained through a drop-front access opening cover.

Another object of the invention herein disclosed and claimed is that of providing a file storge carton in which the cover for the access opening in the front thereof folds down to form a shallow marginally-flanged tray.

Still another objective of the within-described invention is the provision of a front-opening box wherein the access opening cover is releasably maintained in closed position by means of a marginal flap which folds down over the cover and is detachably secured thereto by one or more pile-and-loop fasteners.

An additional object is to provide a stackable file storage carton having double-thickness side and rear walls for additional support.

Further objects are to provide a file storage carton which is rugged and strong, yet inexpensive; one that is versatile, readily adaptable to various types of files carrying file-identifying indicia on the front edge thereof while opening to reveal all such indicia; and, a unit of the type aforementioned which is simple, convenient to use and even decorative.

Other objects will be in part apparent and in part pointed out specifically hereinafter in connection with the description of the drawings that follows.

DETAILED DESCRIPTION OF THE DRAWINGS

Figure 1:
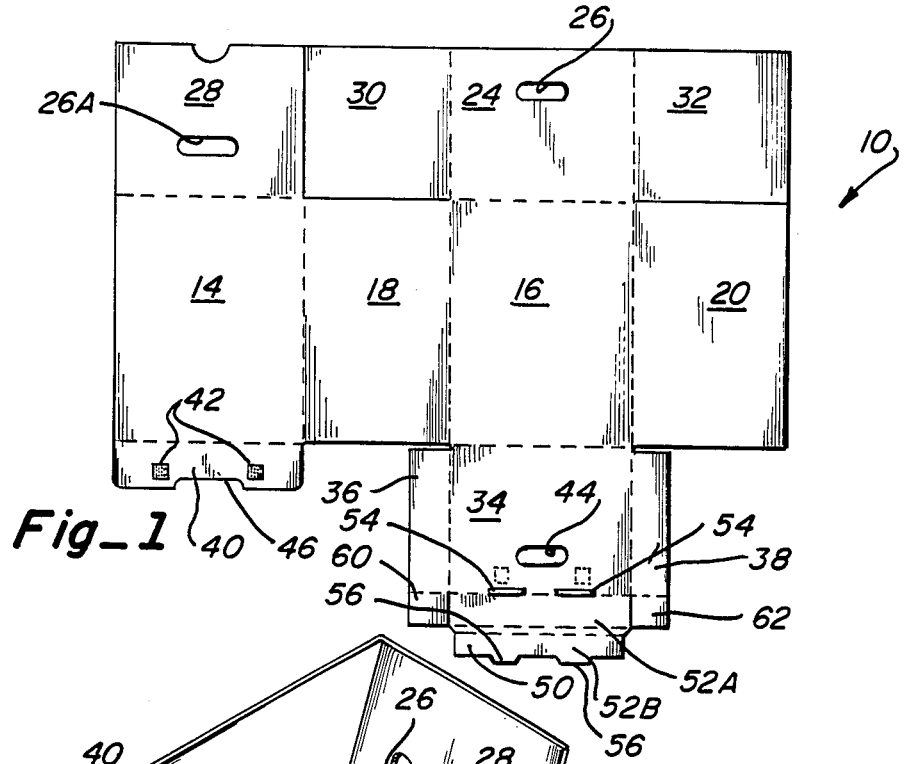
FIG. 1 is a plan view showing the flat blank from which the file storage carton of the present invention is constructed.
Figure 2:
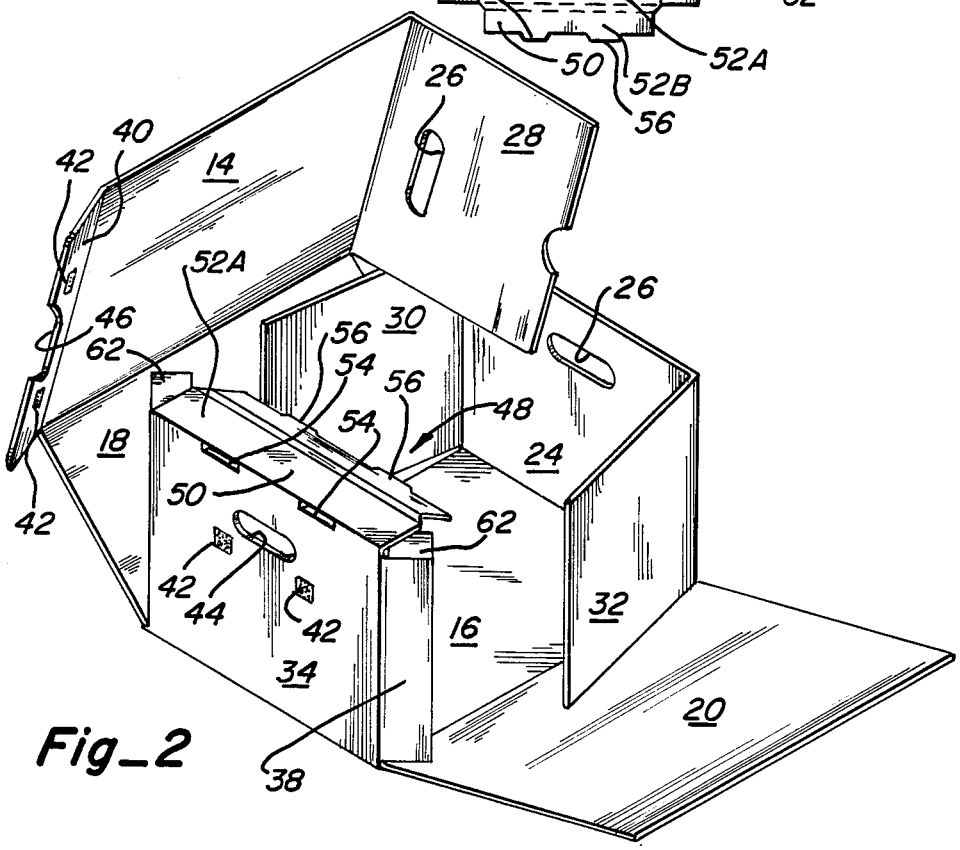
FIG. 2 is a perspective view showing the blank illustrated in FIG. 1 in partially folded condition.
Figure 3:
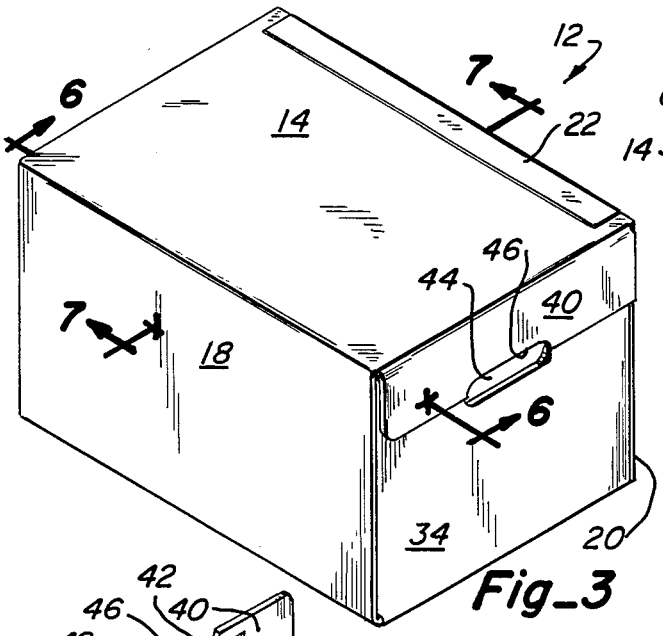
FIG. 3 is a perspective view showing the completed file storage carton to a slightly enlarged scale.

Turning to the drawings for a detailed description of the present invention, FIG. 1 illustrates a storage carton blank indicated in a general way be reference numeral 10 consisting of a large sheet of foldable sheet material cut and scored to provide a plurality of panels hingedly connected together in such a manner that when folded in the manner shown in FIG. 2 they will ultimately from the carton shown in FIG. 3, the latter having been broadly identified by reference numeral 12. As seen in FIG. 1, blank 10 is cut and scored to define a top generally rectangular panel 14, a bottom generally rectangular panel 16, a left outside side panel 18 interconnecting, in the particular arrangement shown, the lefthand margins of the top and bottom panels, and a right outside side panel 20 connected to the righthand margin of the bottom panel which will ultimately be joined to the righthand edge of the top panel 14 as seen most clearly in FIGS. 3 and 7 by a strip of tape 22 or other connecting means. An outside rear wall panel 24 rises vertically from the rear edge of the bottom panel 16 and is preferably provided with a transversely-elongate cutout 26 that functions as one part of a two-part handhold. An inside rear wall panel 28 connected to the rear edge of the top panel 14 extends down the outside of outside rear wall panel 24 in the manner shown most clearly in FIGS. 2 and 6 thus cooperating with the latter to define a double-thickness rear wall subassembly. Inside rear wall panel 28 also includes a handhold opening 26A which registers in assembled relation with the one 26 in outside rear wall panel 24 as shown in FIG. 6 to complete the two-part handhold.

A left inside wall panel 30 is formed by cutting along the righthand edge of the rear inside wall panel 28 and the rear edge of left outside side panel 18 while leaving it connected to rear outside wall panel 24 in the manner shown in FIGS. 1 and 2. Similarly, the right inside wall panel 32 is fashioned as shown in FIGS. 1 and 2 by cutting along the rear edge of right outside side panel 20 while leaving it connected to the righthand edge of rear outside wall panel 24. Obviously, the length of these right and left inside wall panels 30 and 32 is limited to the height of the right and left outside wall panels 14 and 20. Therefore, if as shown, the length of right and left outside wall panels 18 and 20, respectively, is greater than the height thereof, then, obviously, panels 30 and 32 will terminate short of the access opening cover 34 at the front of the carton. As a practical matter, this will amost always be the case if the carton is dimensioned to receive the files in upstanding front-to-rear relation since most all files are longer than they are high. Nevertheless, these right and left inside wall panels cooperate with the right and left marginal flanges 36 and 38, respectively, bordering the side margins of the access opening cover 34 when the latter is closed as shown in FIGS. 3 and 6 to define a double-thickness wall subassemblies over most of their length.

Figure 6:
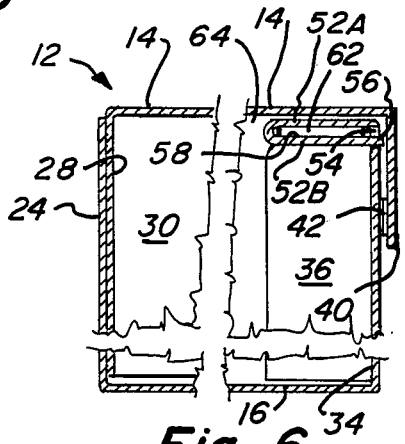
FIG. 6 is a section to a greatly enlarged scale taken along line 6—6 of FIG. 3, portions having been broken away to conserve space.
Figure 7:
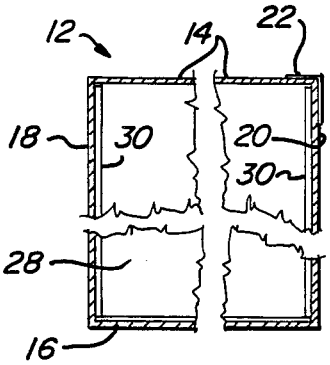
FIG. 7 is a section to the same scale as FIG. 6 taken along line 7—7 of FIG. 3, again with portions broken away to conserve space; and, FIG. 8 is a fragmentary perspective view to a further enlarged scale showing the corner construction of the tray.

A transversely-extending flap 40 is provided on the front edge of the top 14 positioned and adapted to fold down over the front of the access opening cover in the manner shown in FIGS. 3 and 6 when the latter is closed. Two-part separable pile-and-loop fasteners 42 carried in face-to-face relation on opposed surfaces of this flap and the access opening cover releasably hold the latter closed. A transversely-extending handhold 44 corresponding to handhold 26 in the rear wall assembly is also provided as shown in the access opening cover 34. A portion 46 of this handhold is shown provided along the bottom edge of flap 40 so as to cooperate with the access opening cover to provide a double-thickness lifting area like is found on the rear wall. In other words, the lower edge of flap 40 preferably extends along the top of the handhold 44 to strengthen the area at the front of the carton where it is to be lifted.

Figure 4:
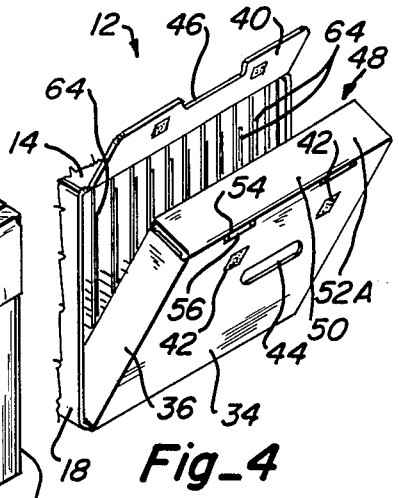
FIG. 4 is a perspective view similar to FIG. 3 and to the same scale showing the flap lifted and the access opening cover partially open.
Figure 5:
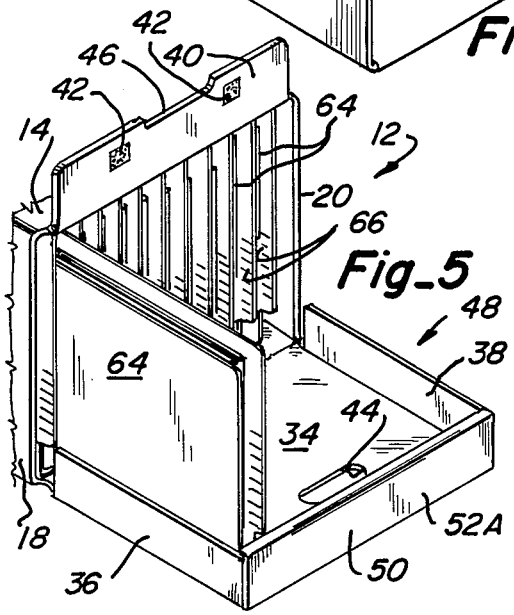
FIG. 5 is a perspective view similar to FIG. 3 and, once again, to the same scale showing the access opening cover fully open in tray-forming relation.

Certainly one of the most unique features of the storage carton forming the subject matter of the instant application is the construction by means of which the access opening cover and its marginal appurtenances cooperate to define a tray indicated in a general way by reference numeral 48 when opened and laid flat in the manner shown in FIG. 5. As seen most clearly in FIGS. 1 and 2, access opening cover 34 is bordered on both sides by the flanges 36 and 38 each of which folds into the upright position shown in FIGS. 4 and 5 where they define upstanding fence-like barriers along the sides of the aforementioned tray.

Figure 8:
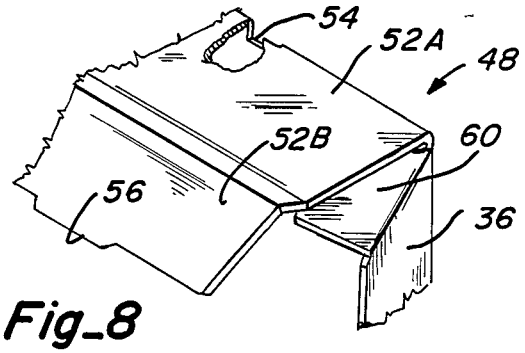

With particular reference to FIGS. 1, 2 and 8, the access opening cover 34 will be seen to include a double-wide flange 50 extending along its front edge. This flange comprises two sections 52A and 52B. When section 52B is folded over atop section 52B into face-to-face relation with the latter and then the two together are folded into an upstanding position, they cooperate to define the front fence-forming wall or barrier of the tray 48. Transverse slits 54 extending along the innermost fold line of double-wide flange 50 receive tongues 56 spaced apart along the free edge of the flange 52B thus locking the two sections together to form a double-thickness member having a tab-receiving pocket 58 running the entire length thereof which is open at both ends.

The portions in the corners of the blank between the side flanges 36 and 38 and the section 52A of the double wide flange 50 are cut free of the latter to form tabs 60 and 62 which fit into the open ends of pocket 58 in the manner most clearly shown in FIGS. 2 and 8 to hold the flanges 36, 38 and 50 in upstanding assembled fence-forming relation. In the actual assembly of the tray 48, the three flanges are first folded into their respective upright positions at which point the tabs 60 and 62 are laid against the inside face of flange section 52A before section 52B is folded over and its tongues 56 secured in their respective notches 54. When assembled in this fashion, the tabs 60 and 62 are securely seated in the pocket 58 formed by the folded front flange 50.

The overall inside height of the resulting carton as seen in FIGS. 4 and 5 is such that a space 64 is left above the row of files 66 sized to accommodate the front flange 50, its tab-receiving pocket 58 and the tabs 60 and 62 contained therein as shown most clearly in FIG. 6. To open the carton, flap 40 is lifted as seen in FIG. 4 unfastening the pile-and-loop fasteners 42, whereupon, the access opening cover 34 can be dropped down into the position shown in FIG. 5. It, together with the upstanding flanges 36, 38 and 50 that border the latter and cooperate therewith to form the tray 48 when dropped down into the fully open position of FIG. 5 permit a file 64 to be slid forward out of the row thereof and examined. As previously mentioned, the height of the tray is such that the file cannot be slid forward far enough to leave the confines of the carton completely and fall over; yet, it can come far enough forward to be lifted over the front flange 50 and removed due to the space 64 left thereabove.

The handholds front and rear facilitate removal of the carton from a stack thereof and also its movement from place to place. Both handholds are positioned either in or directly beneath a double-thickness section of the rear and front walls, the latter being formed by the overlapping flap 40 and the access opening cover 34 in closed position. With side flanges 36 and 38 inside the carton lying adjacent sidewalls 18 and 20, they cooperate with wall sections 30 and 32 to reinforce the sidewalls of the carton over most of their length.

I claim:

1. A storage carton blank comprising:

(A) a polygonal bottom panel having a righthand marginal edge, a lefthand marginal edge, a rear marginal edge and a front marginal edge;

(B) a polygonal left outside panel having a righthand marginal edge hingeably connected to said bottom panel lefthand marginal edge, a lefthand marginal edge, a rear marginal edge and a front marginal edge;

(C) a polygonal right outside panel having a lefthand marginal edge hingeably connected to said bottom panel righthand marginal edge, and a rear marginal edge;

(D) a polygonal top pane having a righthand marginal edge hingeably connected to said left outside panel lefthand marginal edge, a rear marginal edge, and a front marginal edge;

(E) a polygonal inside rear wall panel having a front marginal edge hingeably connected to said top panel rear marginal edge, a rear marginal edge, and an elongated cutout defined therein;

(F) a polygonal outside rear wall panel having a front marginal edge hingeably connected to said bottom panel rear marginal edge, a righthand marginal edge, a lefthand marginal edge and an elongated cutout defined therein to be positioned to be coincident with said inside rear wall panel cutout to form a storage carton double-thickness handhold in the storage carton set-up configuration;

(G) a polygonal left inside wall pane having a righthand marginal edge hingeably connected to said outside rear wall panel lefthand marginal edge, a lefthand marginal edge and a rear marginal edge;

(H) a polygonal right inside wall panel having a lefthand marginal edge hingeably connected to said outside rear panel righthand marginal edge, and a front marginal edge;

(I) a polygonal access opening cover having a rear marginal edge hingeably connected to said bottom panel front marginal edge, a righthand marginal edge, a lefthand marginal edge, a front marginal edge, an elongated cutout defined therein, and two elongated slots defined therein adjacent to said access opening cover front marginal edge;

(J) a polygonal front flap having a rear marginal edge hingeably connected to said top panel front marginal edge, a righthand marginal edge hingeably connected to said left outside panel lefthand marginal edge, a rear marginal edge hingeably connected to said inide rear wall panel front marginal edge, and an elongated notch defined in said front flap front marginal edge and located to co-operate with said access opening cover elongated cutout to form a storage carton double-thickness handhold in a set-up storage carton;

(K) a polygonal double wide flange having a rear marginal edge hingeably connected to said access opening cover front marginal edge, two foldlines dividing said double wide flange into first and second sections which are adapted to lie on top of each other when said double wide flange is folded about said foldlines, a front marginal edge having two tongues located thereon to fit into said access opening cover slots when said double wide flange is folded about said foldlines;

(L) a polygonal right marginal flange having a lefthand marginal edge hingeably connected to said access opening cover righthand marginal edge and a front marginal edge;

(M) a polygonal left marginal flange having a righthand marginal edge hingeably connected to said access opening cover lefthand marginal edge and a front marginal edge;

(N) a two part fastener mounted on said front flap and on said access opening cover for releasably attaching said front flap to said access opening cover;

(O) a polygonal left tab having a rear marginal edge hingeably connected to said left marginal flange front marginal edge and being located to fit between the sections of said double wide flange; and (P) a polygonal right tab having a rear marginal edge hingeably connected to said right marginal flange front marginal edge and being located to fit between the sections of said double wide flange.

2. The improved access opening cover for file storage cartons as set forth in claim 1 wherein: the two-part fastener comprises elements of a pile-and-loop connector.

3. A storage carton comprising:

(A) a polygonal bottom panel having a righthand marginal edge, a lefthand marginal edge, a rear marginal edge and a front marginal edge;

(B) a polygonal left outside panel having a righthand marginal edge hingeably connected to said bottom panel lefthand marginal edge, a lefthand marginal edge, a rear marginal edge and a front marginal edge and being connected to said bottom panel to form one thickness of a first double-thickness side wall of a storage carton;

(C) a polygonal right outside panel having a lefthand marginal edge hingeably connected to said bottom panel righthand marginal edge, and a rear marginal edge and being connected to said bottom panel to form one thickness of a second double-thickness side wall of the storage carton;

(D) a polygonal top panel having a righthand marginal edge hingeably connected to said left outside panel lefthand marginal edge, a rear marginal edge, and a front marginal edge and overlying said bottom panel in spaced relation therewith in the storage carton;

(E) a polygonal inside rear wall panel having a front marginal edge hingeably connected to said top panel rear marginal edge, a rear marginal edge, and an elongated cutout defined therein and being connected to said top panel to form one thickness of a double-thickness rear wall of the storage carton;

(F) a polygonal outside rear wall panel having a front marginal edge hingeably connected to said bottom panel rear marginal edge, a righthand marginal edge, a lefthand marginal edge and an elongated cutout defined therein to be positioned to be coincident with said inside rear wall panel cutout to form a storage carton double-thickness handhold in the storage carton and being connected to said bottom panel to form a second thickness of the double-thickness rear wall of the storage carton;

(G) a polygonal left inside wall pane having a righthand marginal edge hingeably connected to said outside rear wall panel lefthand marginal edge, a lefthand marginal edge and a rear marginal edge and being connected to said outside rear wall panel to form a second thickness of the first double-thickness side wall of the storage carton;

(H) a polygonal right inside wall panel having a lefthand marginal edge hingeably connected to said outside rear panel righthand marginal edge, and a ront marginal edge and being connected to said outside rear panel to form a second thickness of the second double-thickness side wall of the storage carton;

(I) a polygonal access opening cover having a rear marginal edge hingeably connected to said bottom panel front marginal edge, a righthand marginal edge, a lefthand marginal edge, a front marginal edge, an elongated cutout defined therein, and two elongated slots defined therein adjacent to said access opening cover front marginal edge;

(J) a polygonal front flap having a rear marginal edge hingeably connected to said top panel front marginal edge, a righthand marginal edge hingeably connected to said left outside panel lefthand marginal edge, a rear marginal edge hingeably connected to said inside rear wall panel front marginal edge, and an elongated notch defined in said front flap front marginal edge and located to co-operate with said access opening cover elongated cutout to form a storage carton double-thickness handhold in the storage carton;

(K) a polygonal double wide flange having a rear marginal edge hingeably connected to said access opening cover front marginal edge, two foldlines dividing said double wide flange into first and second sections which lie on top of each other, a front marginal edge having two tongues located thereon and which fit into said access opening cover slots;

(L) a polygonal right marginal flange having a lefthand marginal edge hingeably connected to said access opening cover righthand marginal edge and a front marginal edge;

(M) a polygonal left marginal flange having a righthand marginal edge hingeably connected to said access opening cover lefthand marginal edge and a front marginal edge;

(N) a two part fastener mounted on said front flap and on said access opening cover for releasably attaching said front flap to said access opening cover;

(O) a polygonal left tab having a rear marginal edge hingeably connected to said left marginal flange front marginal edge and fitting between the sections of said double wide flange; and (P) a polygonal right tab having a rear marginal edge hingeably connected to said right marginal flange front marginal edge and fitting between the sections of said double wide flange.

* * * * *